US006132254A

United States Patent [19]

Wu

[11] Patent Number: 6,132,254

[45] Date of Patent: Oct. 17, 2000

[54] MULTI-PORT CONNECTION DEVICE

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/311,175

[22] Filed: May 13, 1999

[30] Foreign Application Priority Data

Nov. 6, 1998 [TW] Taiwan ..... 87218448

[51] Int. Cl.[7] ..... H01R 13/648

[52] U.S. Cl. ..... 439/607; 439/540.1

[58] Field of Search ..... 439/607, 608, 439/609, 701, 79, 541.5, 540.1

[56] References Cited

U.S. PATENT DOCUMENTS 5,637,015 6/1997 Tan et al. .

*Primary Examiner*—Neil Abrams
*Assistant Examiner*—Javaid Nasri
*Attorney, Agent, or Firm*—Wei Te Chung

[57] ABSTRACT

A multi-port connection device includes an outer casing having a base section from which a rear section and two opposite lateral sections extend to define an interior space. A partition is arranged in the interior space and divides the interior space into two sub-spaces defined between the partition and the lateral side sections. Each sub-space receives a connector unit therein. The partition and the lateral side sections have retaining members engaging with openings defined in the corresponding connector unit thereby retaining the connector units in the outer casing and forming a unitary device having two connection ports. A multi-port connection device having more than two connector units may also be obtained by providing an outer casing having two or more partitions thereby defining more than two sub-spaces in the outer casing for receiving and retaining the connector units therein.

8 Claims, 4 Drawing Sheets

MULTI-PORT CONNECTION DEVICE

BACKGROUND OF THE INVENTION

1. Field of the Invention

The present invention generally relates to an electrical connection device, and in particular to a connection device comprising a plurality of connector units integrated as a unitary device.

2. The Prior Art

Electrical connectors are used to establish connection between an electrical device and related external elements. With the increasing number of functions that an electrical device is required to perform, the number of connectors mounted in the electrical device is increased for connecting to more external devices. Conventional connectors, such as those disclosed in Taiwan Patent Application Nos. 84104611, 85213720 and 86200240, have only a single connection port whereby the connector may only be connected to a single external device. In addition, conventional connectors must be individually mounted to the electrical device which is time and cost inefficient.

It is thus desirable to provide an electrical connection device comprising a plurality of connector units integrated together as a single device thereby facilitating the assembly of connectors to an electrical device.

SUMMARY OF THE INVENTION

Accordingly, an object of the present invention is to provide a multi-port electrical connection device comprising a plurality of connector units integrated together as a unitary device thereby facilitating the assembly of a number of connectors to an electrical device.

To achieve the above objects, an electrical connection device in accordance with the present invention comprises an outer casing having a base section from which a rear section and two opposite lateral sections extend to define an interior space. A partition is arranged in the interior space and divides the interior space into two sub-spaces defined between the partition and the lateral side sections. Each sub-space receives a connector unit therein. The partition and the lateral side sections have retaining members engaging with openings defined in the corresponding connector unit thereby retaining the connector units in the outer casing and forming a unitary device having two connection ports. A multi-port connection device comprising more than two connector units may also be obtained by providing an outer casing having two or more partitions thereby defining more than two sub-spaces in the outer casing for receiving and retaining the connector units therein.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
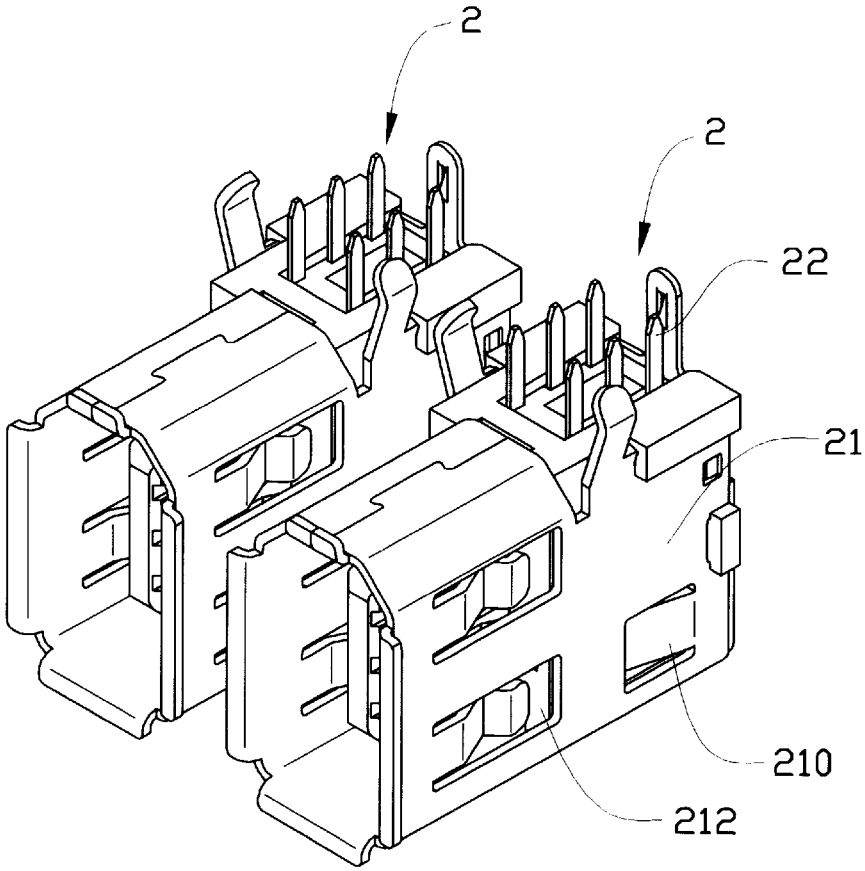
FIG. 1 is an exploded view of a multi-port connection device constructed in accordance with a first embodiment of the present invention.
Figure 1:
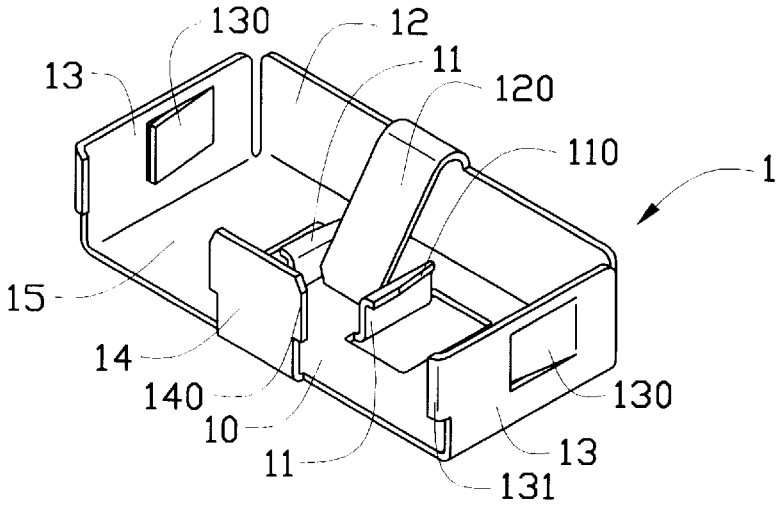
Figure 2:
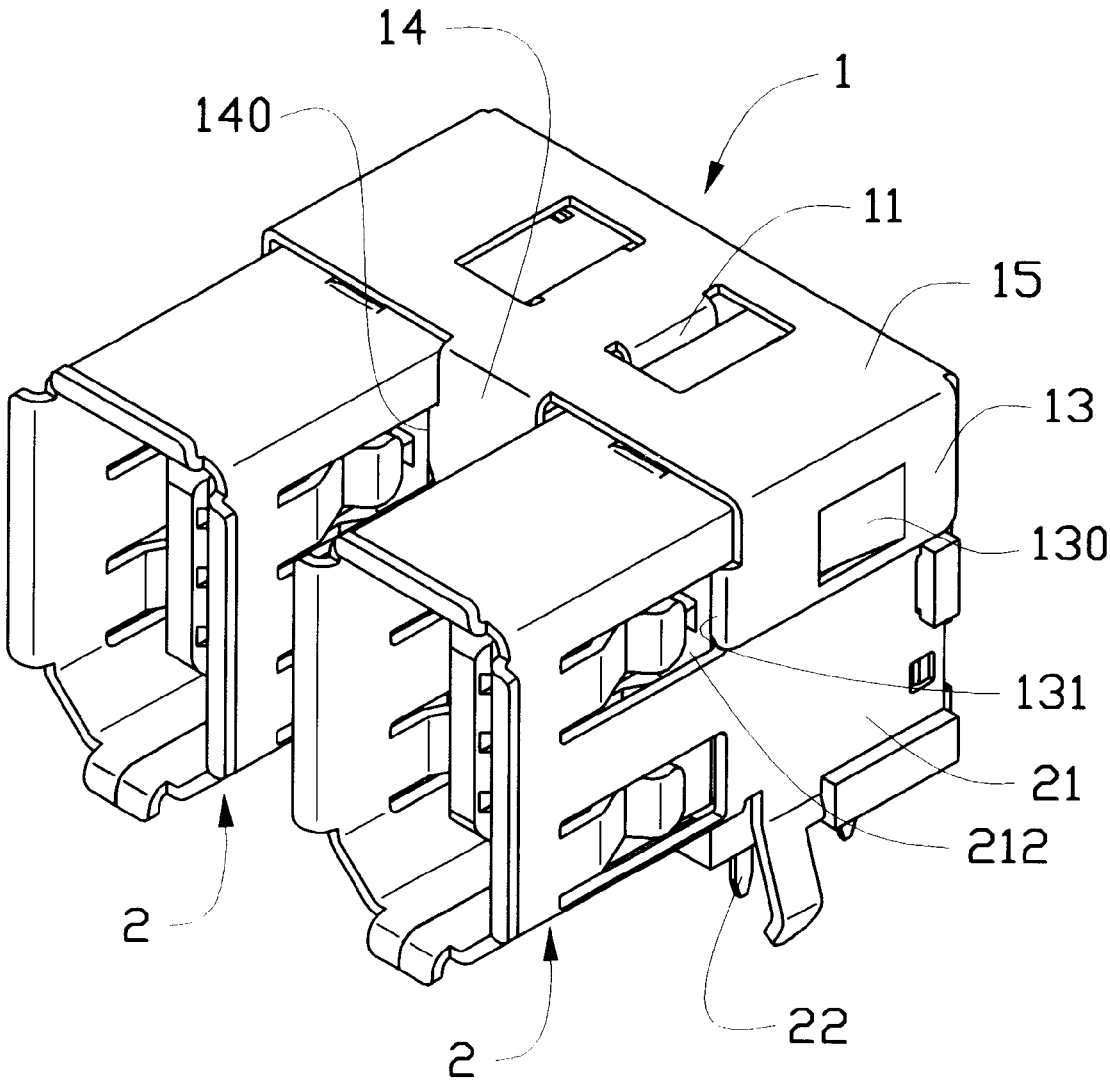
FIG. 2 is an assembled view of FIG. 1.

Referring to the drawings and in particular to FIGS. 1 and 2, wherein a multi-port connection device in accordance with a first embodiment of the present invention is shown, the multi-port connection device comprises two connector units 2 each forming a connection port. The connector units 2 are arranged side by side and fixed together by means of an outer casing 1. The outer casing 1 comprises a casing body 10 made of a metal plate by means of stamping and pressing. The casing body 10 has a base section 15 from which two lateral side sections 13 and a rear section 12 perpendicularly extend to define an interior space (not labeled) therebetween for receiving the connector units 2.

A partitioning means is arranged within the interior space of the outer casing 1 thereby dividing the interior space into two sub-spaces for receiving and retaining the connector units 2 therein. The partitioning means comprises a partition member 120 extending from the rear wall 12 into the interior space. Two retaining tabs 11 extend from the base section 15 on opposite sides of the partition member 120. The retaining tabs 11 are substantially parallel to the lateral side sections 13 thereby defining the sub-spaces therebetween. Each retaining tab 11 forms a flange 110 on a free end thereof. Each lateral side section 13 has an inwardly projecting barb 130 formed thereon.

Each connector unit 2 has a casing 21 defining an opening 210 in opposite side walls thereof for respectively engaging with the barb 130 and the flange 110 thereby retaining the connector unit 2 in the corresponding sub-space of the casing body 10. Conductive pins 22 extend from the connector units 2 for being mounted to a circuit board (not shown).

The partition means further comprises a projection 14 extending from the base section 15. The projection 14 forms an engaging flange 140 on opposite edges thereof. An inwardly projecting arm 131 extends from each lateral side section 13 corresponding to the engaging flanges 140. The arm 131 and the corresponding engaging flange 140 are partially received in and engage- with openings 212 defined in the casing 21 of the connector unit 2 for securely retaining the connector unit 2 in the outer casing 1.

Figure 3:
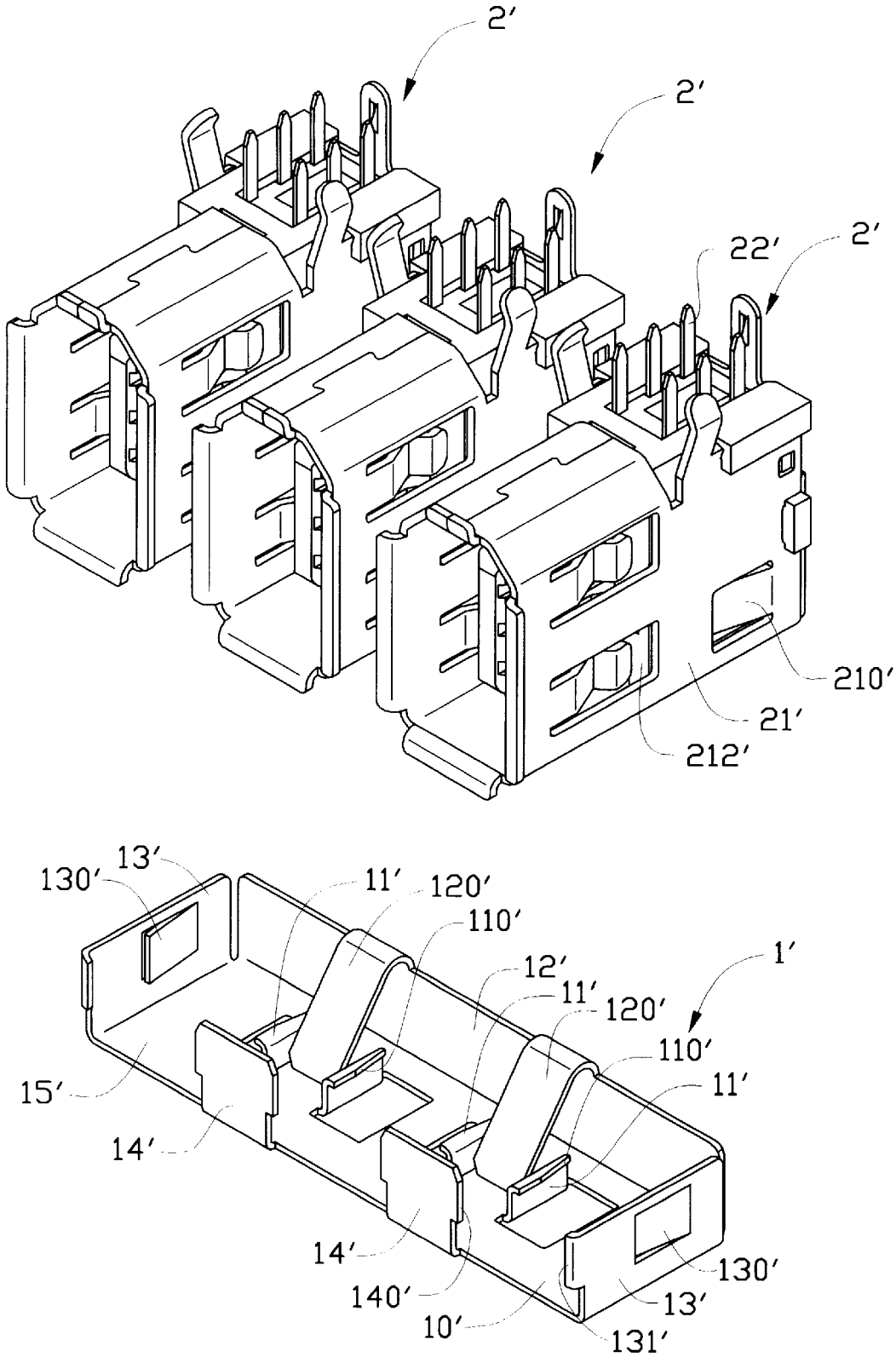
FIG. 3 is an exploded view of a multi-port connection device constructed in accordance with a second embodiment of the present invention.
Figure 4:
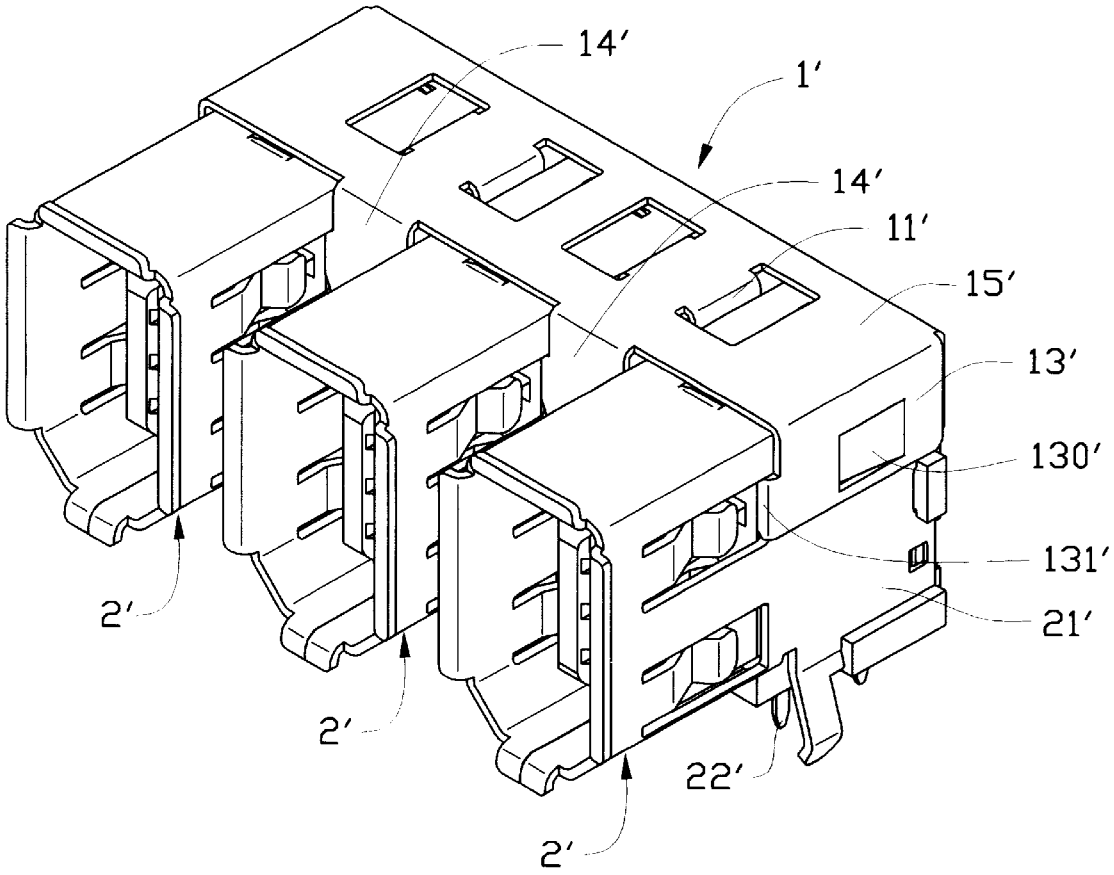
FIG. 4 is an assembled view of FIG. 3.

FIGS. 3 and 4 show a second embodiment of the present invention which is an expansion of the first embodiment shown in FIGS. 1 and 2. In the second embodiment, the multi-port electrical connection device of the present invention comprises three connector units 2', which may be identical to the connector units 2 of the first embodiment, arranged side by side. Each connector unit 2' has a casing 21' defining openings 210', 212' in opposite sides thereof. Conductive pins 22' extend from each connector unit 2' for being mounted to a circuit board (not shown).

An outer casing 1' receives the connector units 2' therein and fixes the connector units 2' together as a unitary device. The outer casing 1' comprises a casing body 10' having a base section 15' from which a rear section 12' and two opposite lateral side sections 13' perpendicularly extend thereby defining an interior space (not labeled) therebetween for receiving the connector units 2'. Two partition means are arranged in the interior space for dividing the interior space into a central sub-space and two side sub-spaces (both not labeled) for receiving the connector units 2'. Each partitioning means comprises a partition member 120' extending from the rear section 12' into the interior space. Two retaining tabs 11' extend from the base section 15' on opposite sides of each partition member 120' and are substantially parallel to the lateral side sections 13' whereby the side sub-spaces are defined between the retaining tabs 11 and the lateral side sections 13' and the central sub-space is defined between the retaining tabs 11. The connector units 2' are received in the corresponding sub-spaces.

A flange 110' is formed at a free end of each retaining tab 11' and an inwardly projecting barb 130' extends from each lateral side section 13' toward the corresponding retaining tab 11'. Each barb 130' and the corresponding flange 110' are received in and engage with the openings 210' of the associated side connector unit 2', while the flanges 110' of the retaining tabs 11' defining the central sub-space are similarly received in and engage with the openings 210' of the central connector unit 2'.

Two projections 14' extend from the base section 15' corresponding to the partition members 120'. Each projection 14' has a first edge opposing an inwardly projecting arm 131' extending from a front edge of the corresponding lateral side section 13' and a second edge opposing the second edge of the other projection 14'. An engaging flange 140' is formed on each edge of the projection 14'. The engaging flanges 140' and the arms 131' are partially received in and engage with the openings 212' of the connector unit 2' for securely retaining the connector unit 2' in the outer casing 1'.

Quite apparently, by increasing the size of the base section 15, 15' and the number of the partition members 120, 120', the interior space of the outer casing 1, 1' may be divided into more sub-spaces for accommodating more connector units 2, 2'. Thus, an increased number of connectors can be integrated as a unitary device thereby simplifying the process of mounting the connectors to an electrical device.

The outer casing 1, 1', which may be made of a metal plate for cooperating with the metal casing 21, 21', is also used to ground and shield (for EMI protection) the connector units 2, 2' received and retained therein. It is also noted that the outer casing 1, 1' is open to the exterior around its front/bottom portion, and thus allows to snap onto the top portion of the corresponding connector units 2, 2' without influencing the mounting portion on the bottom of the connector units 2, 2'. Therefore, the connector units may still be properly mounted unto the board as usual.

Although the present invention has been described with reference to preferred embodiments, it is apparent to those skilled in the art that a variety of modifications and changes may be made without departing from the scope of the present invention which is intended to be defined by the appended claims.

What is claimed is:

1. An electrical connection device comprising an outer casing having a base section from which a rear section and two opposite lateral side sections extend to define an interior space therebetween, and at least one partition means arranged in the interior space to divide the interior space into at least two sub-spaces for each receiving a connector unit therein, the connector unit having a casing defining first openings in opposite sides thereof, the partition means and the lateral side sections having first retaining means formed thereon and associated with each of the sub-spaces for engaging with the first openings of the corresponding connector units whereby a unitary device comprising a number of connection ports constituted by the connector units is formed.

2. The electrical connection device as claimed in claim 1, wherein the first retaining means of each lateral side section comprises an inwardly projecting barb engaging with the corresponding first opening of the connector unit and wherein the first retaining means of the partition means comprises a first flange engaging with the corresponding first opening of the connector unit.

3. The electrical connection device as claimed in claim 2, wherein the partitioning means comprises two opposite tabs extending from the base section, each tab having a bent free edge forming the first flange engaging with the first opening of the corresponding connector unit.

4. The electrical connection device as claimed in claim 1, wherein the partitioning means comprises a partition member extending from the rear section into the interior space.

5. The electrical connection as claimed in claim 1, wherein the outer casing comprises two partitioning means arranged in the interior space thereof thereby dividing the interior space into a central sub-space and two side sub-spaces for receiving a central connector unit and two side connector units therein.

6. The electrical connection device as claimed in claim 1, wherein the casing of each connector unit comprises second openings on the opposite sides thereof, and wherein the lateral side sections and the partitioning means further comprise second retaining means engaging with the second openings of the connector units for securely retaining the connectors in the outer casing.

7. The electrical connection device as claimed in claim 6, wherein the second retaining means of the lateral side sections comprises an inwardly projecting arm extending from a front edge of each lateral side section and engaging with the corresponding second opening of the connector unit, and wherein the second retaining means of the partitioning means comprises a second flange engaging with the second opening of the corresponding connector unit.

8. The electrical connection device as claimed in claim 7, wherein the partitioning means comprises a projection extending from the base section having two opposite edges, each edge forming the second flange of the partitioning means for engaging with the second opening of the connector unit.

* * * * *